US007541531B1

(12) United States Patent
Jacobson

(10) Patent No.: US 7,541,531 B1
(45) Date of Patent: Jun. 2, 2009

(54) ADJUSTABLE SPRING RETURN FOR BASS DRUM PEDAL

(76) Inventor: Lucas A. Jacobson, 5708 Pennsylvania Ave. N., Crystal, MN (US) 55428

( * ) Notice: Subject to any disclaimer, the term of this patent is extended or adjusted under 35 U.S.C. 154(b) by 345 days.

(21) Appl. No.: 11/511,130

(22) Filed: Aug. 28, 2006

(51) Int. Cl.
*G10D 13/02* (2006.01)

(52) U.S. Cl. ..... 84/422.1

(58) Field of Classification Search ..... 84/422.1, 84/422.2, 422.3, 327, 329, 421
See application file for complete search history.

(56) References Cited

U.S. PATENT DOCUMENTS 4,567,808 A 2/1986 Smith
4,691,613 A 9/1987 Jacobson
5,266,733 A 11/1993 Jacobson
5,574,237 A 11/1996 Yanagisawa
6,259,012 B1 * 7/2001 Hoshino ..... 84/422.1
6,590,147 B2 7/2003 Kassabian

* cited by examiner

*Primary Examiner*—Kimberly R Lockett

(57) ABSTRACT

A spring return for a bass drum pedal includes a spring with ears at opposing ends, one ear connected to the pedal frame and the other ear connected to a pivot arm attached to the pedal driveshaft. The pivot arm includes a hub mounted on the driveshaft and a shaft extending radially therefrom. A collar is journaled on the shaft and includes a setscrew to permit selectively locking of the collar at desired locations along the shaft. A pin mounted on the collar has an aperture for receiving one ear of the spring, thereby permitting selective adjustment of the distance between the spring ear and the driveshaft, to thereby adjust the ratio of driveshaft rotation to spring pressure.

17 Claims, 3 Drawing Sheets

ADJUSTABLE SPRING RETURN FOR BASS DRUM PEDAL

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not Applicable)

INCORPORATION-BY-REFERENCE OF MATERIAL SUBMITTED ON A COMPACT DISC (Not applicable)

BACKGROUND OF THE INVENTION (1) Field of the Invention

The present invention relates generally to bass drum pedals, and more particularly to an improved spring return system for bass drum pedals and other foot-operated musical instruments.

(2) Description of Related Art Including Information Disclosed Under 37 CFR 1.97, 1.98

Although bass drum pedals 11 on the market today use a wide variety of different apparatus for driving a beater or hammer against a drum head, they all rely on three basic components connected to a drive shaft: a beater 12, a foot plate 14, and a spring return 16, as shown in FIG. 1 of the drawings. The beater 12 includes a head or hammer 18 mounted on a distal end of a shaft 20, with the proximal end of the shaft attached to a rotatable drive shaft 22 on a frame 24. Rotation of the drive shaft 22 swings the beater 12 through an arc equal to the angular rotation of the drive shaft 22, towards and away from a drum head 26, to thereby cause an impact of the beater 12 with the drum head 26. The drive shaft 22 is linked to a pivotable footplate 14 with a cable or chain 28, such that depressing the footplate 14 will cause the drive shaft 22 to rotate and swing the beater 12 towards the drum head 26. The spring return 16 is connected between the drive shaft 22 and the frame 24, and biases the drive shaft 22 to return the beater 12 from its impact with the drum head 26 while simultaneously raising the depressed footplate 14 to permit a subsequent stroke.

While there are many different ways that prior art pedals actually connect spring return 16 to driveshaft 22, the most common is by the releasable attachment of a link 30 to drive shaft 22. This may be accomplished by a set screw 32, or any other means that locks the link 30 in the desired position on shaft 22, so that link 30 will rotate with shaft 22. One ear **34*a* of a coil spring 34 is engaged through an aperture 36 in link 30. The opposite ear 34*b* is engaged through an aperture in one end of a threaded rod 38. Threaded rod 38 is journaled through an aperture in a flange 40 on frame 24. A threaded nut 42 is threaded on rod 38 below flange 40, to permit adjustment of the length of rod 38 projecting above flange 40, and thereby adjusting the length of spring 34**.

In general, prior art pedals 11 allow only two spring system adjustments—the altering of the rest point, and the altering of the pre-load length of the spring 34. The rest point is defined as the mechanical position of the bass drum pedal 11 at which the footplate 14 is at rest, i.e. when not being acted upon by a player. This position is also the point at which the spring 34 is under the least amount of tension. FIG. 1 shows a prior art bass drum pedal 11 in the rest position, with the beater shaft 20 resting in a position approximately 60°-80° from drum head 26 with the drive shaft 22 rotated the same degree of rotation in the negative direction. The total operational driveshaft rotation, as measured from 0° at the point of impact of beater hammer 18 with drum head 26 to the point at which spring 34 stops the reverse swing of beater 12, is about 95°-120°.

The rest position of pedal 11 may be adjusted in prior art models by releasing the link 30 from driveshaft 22, which occurs by loosening set screw 32. The desired rest position of beater 12 may then be adjusted by rotating the beater 12 and driveshaft 22. Setscrew 32 is then tightened back onto driveshaft 22, to affix the position of the beater 12.

The second adjustment that is available to the owners of prior art pedals is the adjustment of the pre-load length of spring 34. This is accomplished by the rotation of nut 42 on threaded rod 38. This movement either extends or retracts rod 38 from the upper end of flange 40, thereby effectively increasing or decreasing the spring length.

While both of these adjustments are useful to the drum player, they do not provide the type of additional adjustment that accomplished players desire. For example, a player typically desires to have the beginning of the down-stroke of the pedal with little bias from the return spring, to enable the beater to rapidly increase speed. Then, as the beater approaches the drumhead, the player desires the bias to be geometrically greater, to enable a faster withdrawal of the beater hammer from the drumhead—and thereby permit a faster repeat of the stroke. Thus, it is desired to vary the increase in tension of the spring between the rest position and the impact position. This is not possible with prior art pedals.

As shown in FIG. 2, if it is assumed that the footplate is depressed at a constant speed throughout a stroke, the prior art pedal will have a ratio of driveshaft rotation to spring tension that has a constant, straight slope $S_1$ to the point of impact. The beater is then returned with a negative backlash by virtue of the bias of spring 34 applied to the beater. Because there is no rearward or "negative" force applied to the beater other than the spring force, the momentum of the beater will cause the beater to travel past the rest position, but only a short distance—typically about one-half the amount of forward rotation during the impact stroke. If the player does not depress the footplate again for another stroke of the pedal, the spring 34 will eventually return the pedal to the rest position.

Because a spring provides a constant biasing force throughout the distance that it is stretched, the adjustment of the overall length of the spring does not change the slope of the line—which represents the ratio of driveshaft rotation to spring bias. Rather, the change will increase both the preload force and the total force required at the impact position, by the same amount. Thus, while the amount of force required at the impact position is greater, as desired, the amount of resistance encountered at the beginning of the stroke is also increased—which is contrary to what is desired.

Similarly, changing the rest position of the beater will not change the slope of the line. Rather, it simply increases or decreases the distance through which the beater must travel to impact the drumhead.

BRIEF SUMMARY OF THE INVENTION

It is therefore a general object of the present invention to provide an improved spring return system for a bass drum pedal.

A further object is to provide an improved spring return system for a bass drum pedal, which will allow the player to adjust the ratio of spring bias to the rotation of driveshaft.

Yet another object of the present invention is to provide an improved spring return system that is simple to adjust and easy to use.

These and other objects will be apparent to those skilled in the art.

The bass drum pedal spring return system of the present invention includes a bass drum pedal of the type having a driveshaft mounted on a frame for rotation in a positive direction from a rest position to an impact position on a longitudinal axis of the driveshaft. A spring return assembly is connected between the frame and the driveshaft to bias the driveshaft in a negative direction from the impact position towards the rest position. The spring return assembly includes a spring with ears at opposing ends, one ear connected to the frame and the other ear connected to the driveshaft. The pivot arm of the invention includes a hub mounted on the driveshaft for rotation therewith. A shaft extends radially from the hub within a plane orthogonal to the longitudinal axis of the driveshaft. A collar is journaled on the shaft, and includes a setscrew to permit selectively locking of the collar at desired locations along the shaft. A pin mounted on the collar has an aperture for receiving one ear of the spring, thereby permitting selective adjustment of the distance between the spring ear and the driveshaft, to thereby adjust the ratio of driveshaft rotation to spring pressure.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
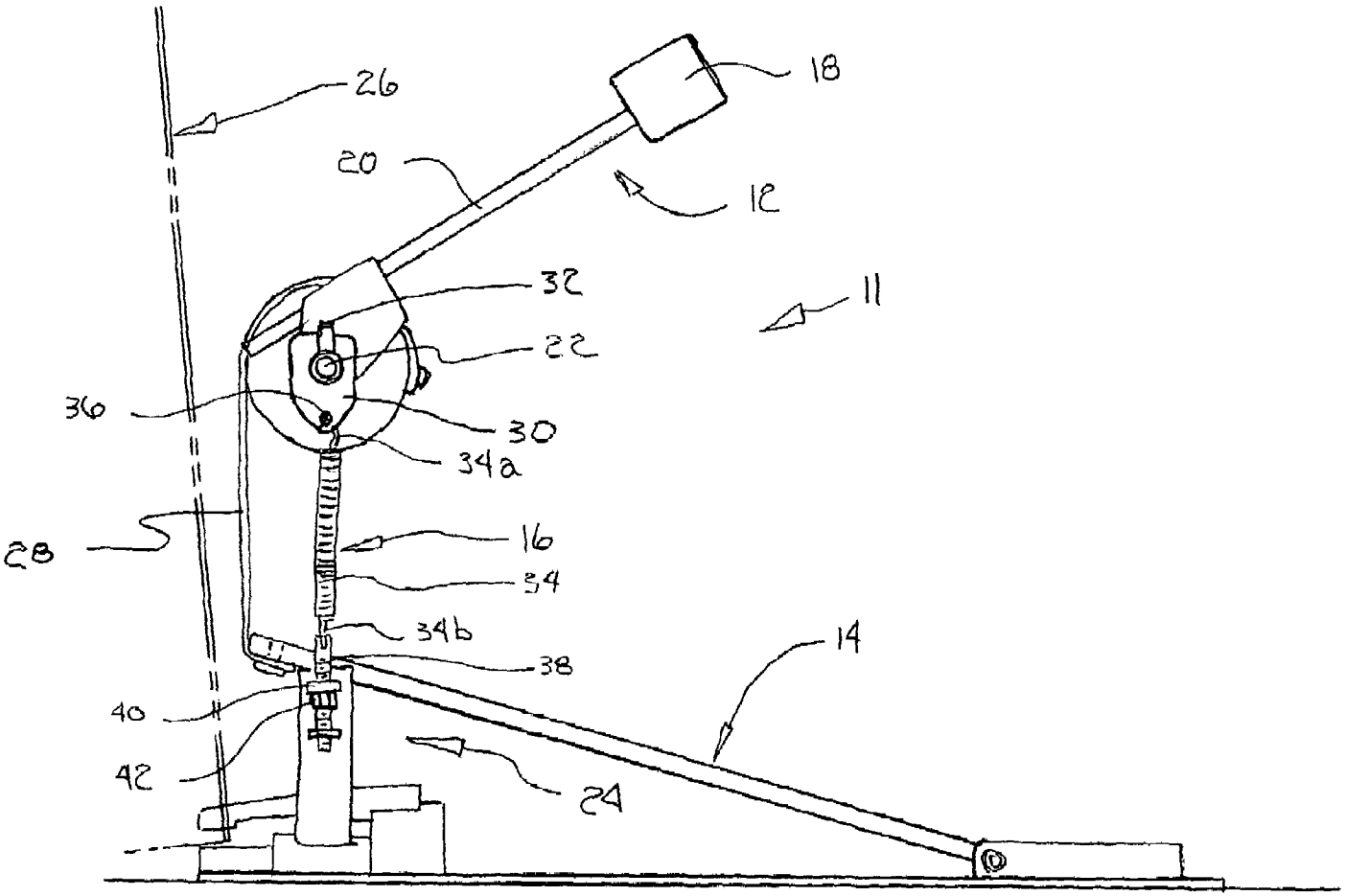
FIG. 1 (PRIOR ART)
FIG. 1 is a side elevational view of a prior art bass drum pedal and spring return system.
Figure 2:
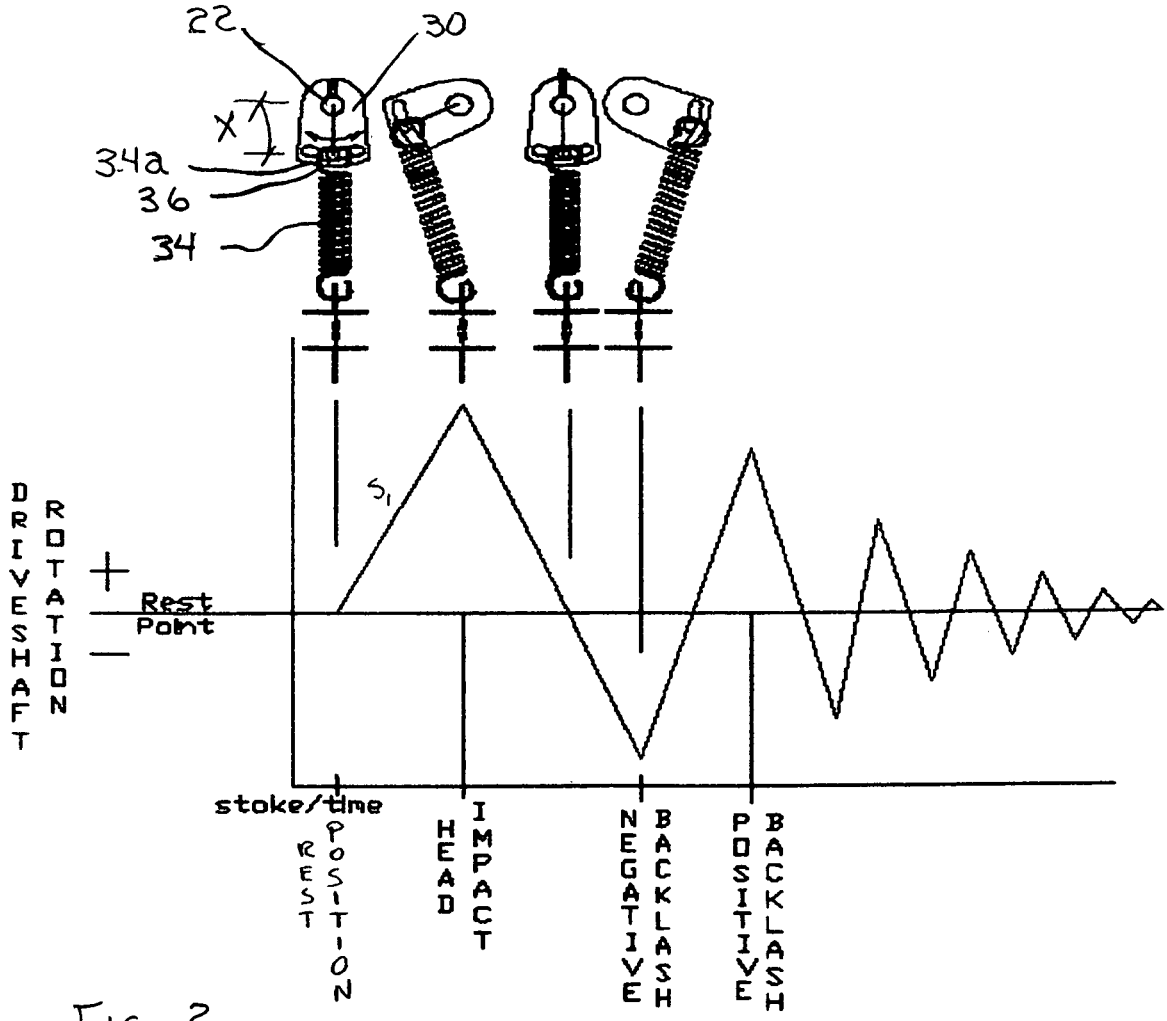
FIG. 2 is a schematic chart showing the relationship between driveshaft rotation and spring tension of the prior art spring return of FIG. 1.

Referring now to the drawings, and more particularly to FIG. 1, a prior art bass drum pedal 11 is shown, with a conventional spring return 16. As discussed above, the location of the upper spring ear 34*a*, engaged in aperture 36 on link 30, fixes the radial distance of the spring ear 34*a* from drive shaft 22. This distance "X", as shown in FIG. 2, essentially forms a pivot arm of fixed length, with the distal end pivoting along a circular path at a radius X from the rotational axis of drive shaft 22.

Figure 3:
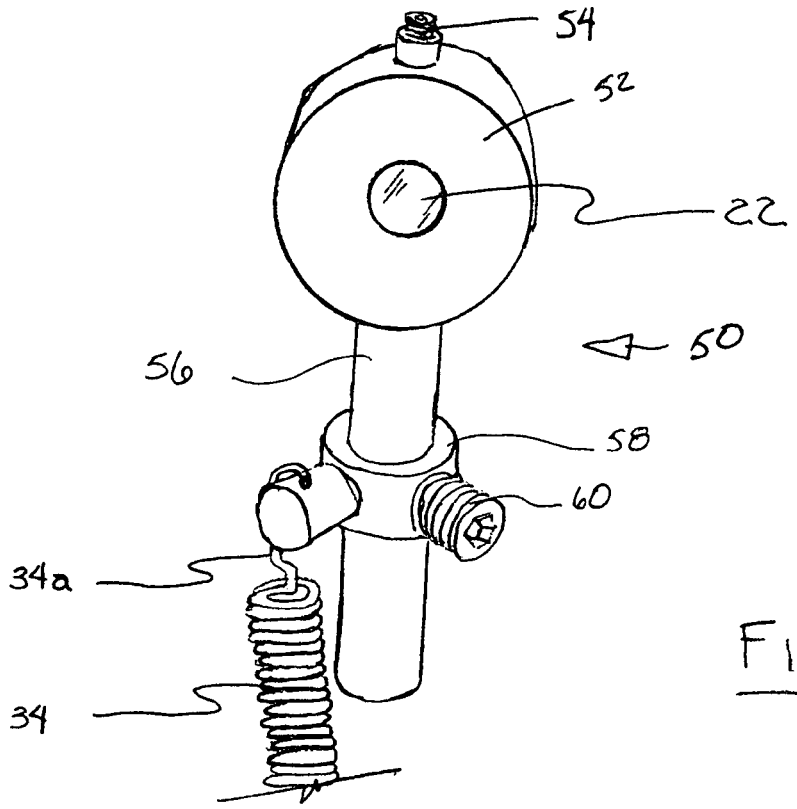
FIG. 3 is an enlarged perspective view of an adjustable pivot arm for the improved spring return of the present invention.

Referring now to FIG. 3, the link 30 (shown in FIGS. 1 and 2) of prior art pedals 11 is replaced with a new and improved adjustable pivot arm, designated generally at 50, which is connected between the upper ear 34*a* of spring 34 and driveshaft 22. Pivot arm 50 includes a hub 52 mounted on driveshaft 22, with a setscrew 54 permitting selective adjustment of the rotational position of hub 52 on driveshaft 22. Setscrew 54 thereby allows selective adjustment of the rest position of the pedal in a fashion similar to that of the prior art.

A shaft 56 extends radially outwardly from hub 52 in a plane orthogonal to the axis of driveshaft 22. A collar 58 is slidably mounted on shaft 56 for movement along the length of shaft 56. A setscrew 60 in collar 58 will selectively set collar 58 in the desired position along shaft 56. A pin 62 projects from collar 58, and has an aperture 64 therethrough that receives upper ear 34*a* of spring 34.

Figure 4:
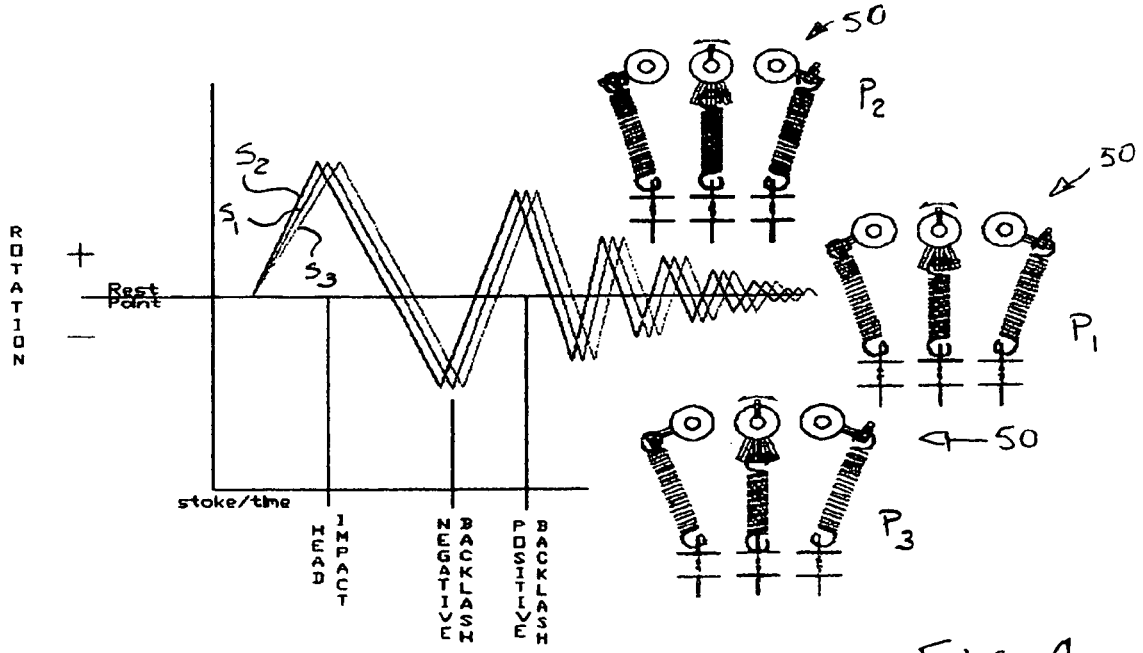
FIG. 4 is a schematic chart showing the relationship between driveshaft rotation and spring tension of three positions of the adjustable spring return of FIG. 3.

Referring now to FIG. 4, a schematic diagram is provided showing how it is possible to adjust the slope of the line representing the ratio of the driveshaft rotation to spring tension by adjusting the location of collar 58 on shaft 56 (shown in FIG. 3). More specifically, position $P_1$ of pivot arm 50 is also shown in FIG. 3, with collar 58 positioned midway between hub 52 and the distal end of shaft 56. This position is intended to substantially match the length of prior art pivot arm lengths. For this reason the shape and slope of line $S_1$ in the chart of FIG. 4 is substantially the same as that of line $S_1$ in FIG. 2. Movement of collar 58 towards hub 52 results in the positioning of the pivot arm 50 as shown at position $P_2$ in FIG. 4, and line $S_2$ in the chart. Movement of collar 58 outwardly to the end of shaft 56 results in the positioning of pivot arm 50 as shown in position $P_3$ and line $S_3$ of the chart.

It can therefore be seen that the adjustable pivot arm 50 of the present invention results in an improved spring return that allows a player to selectively adjust the ratio of driveshaft rotation to spring tension, as desired.

Whereas the invention has been shown and described in connection with the preferred embodiments thereof, many modifications, substitutions and additions may be made which are within the intended broad scope of the appended claims.

What is claimed is:

1. An adjustable pivot arm for a bass drum pedal of the type having a driveshaft mounted on a frame for rotation in a positive direction from a rest position to an impact position on a longitudinal axis of the driveshaft, and a spring return assembly connected between the frame and the driveshaft to bias the driveshaft in a negative direction from the impact position towards the rest position, said spring return assembly including a spring with first and second ears at opposing ends, the first ear connected to the frame and the second ear connected to the driveshaft, comprising:

a hub mounted on said driveshaft for rotation therewith; and adjustable retention means connected to the hub for retaining the second ear of the spring of the spring return assembly;

said adjustable retention means including means for selectively adjusting the location of the second ear along a radial line orthogonal to the driveshaft longitudinal axis.

2. The adjustable pivot arm of claim 1, wherein said pivot arm includes a shaft extending radially from the hub within a plane orthogonal to the longitudinal axis of the driveshaft.

3. The adjustable pivot arm of claim 2, wherein said hub is adjustably mounted on the driveshaft, for selective adjustment about the longitudinal axis of the driveshaft.

4. The adjustable pivot arm of claim 3, wherein said adjustable retention means includes a collar selectively adjustably mounted on the shaft for selective slidable adjustment along the shaft.

5. The adjustable pivot arm of claim 4, wherein said adjustable retention means further includes a pin mounted on the collar with means for engaging the spring second ear.

6. The adjustable pivot arm of claim 5, wherein the collar of said adjustable retention means further includes a set screw journaled through a threaded aperture, for selective engagement with the shaft to selective secure the collar in a desired position.

7. The adjustable pivot arm of claim 1, wherein said hub is adjustably mounted on the driveshaft, for selective adjustment about the longitudinal axis of the driveshaft.

8. The adjustable pivot arm of claim 2, wherein said adjustable retention means includes a collar selectively adjustably mounted on the shaft for selective slidable adjustment along the shaft.

9. The adjustable pivot arm of claim 8, wherein said adjustable retention means further includes a pin mounted on the collar with means for engaging the spring second ear.

10. The adjustable pivot arm of claim 9, wherein the collar of said adjustable retention means further includes a set screw journaled through a threaded aperture, for selective engagement with the shaft to selective secure the collar in a desired position.

11. An adjustable pivot arm for a bass drum pedal spring return assembly, comprising:

a hub having means for mounting the hub to a driveshaft on a bass drum pedal, said hub having a rotational axis;

adjustable retention means connected to the hub for retaining one end of a spring of the spring return assembly;

said adjustable retention means including means for selectively adjusting the location of the second ear along a radial line orthogonal to the hub rotational axis;

said pivot arm including a shaft extending radially from the hub within a plane orthogonal to the rotational axis of the hub; and said adjustable retention means including a collar selectively adjustably mounted on the shaft for selective slidable adjustment along the shaft.

12. The adjustable pivot arm of claim 11, wherein said adjustable retention means further includes a pin mounted on the collar with means for engaging the spring end.

13. The adjustable pivot arm of claim 12, wherein the collar of said adjustable retention means further includes a set screw journaled through a threaded aperture, for selective engagement with the shaft to selective secure the collar in a desired position.

14. A bass drum pedal, comprising:

a frame;

a footplate pivotally connected proximal a heel end to the frame;

a generally horizontally disposed rotatable drive shaft supported on the frame above a forward end of the footplate;

a beater, including a hammer carried at the end of a beater shaft connected to the driveshaft;

a drive assembly connecting the footplate and drive shaft, for rotating the driveshaft to move the hammer in contact with a drum when the footplate is pivoted; and a spring return assembly connected between the frame and the driveshaft, for resisting rotational movement of the driveshaft, said spring return assembly including:

a spring with first and second ears at opposing ends, the first ear connected to the frame and the second ear connected to the driveshaft:

a hub mounted on said driveshaft for rotation therewith; and adjustable retention means connected to the hub for retaining the second ear of the spring of the spring return assembly;

said adjustable retention means including means for selectively adjusting the location of the second ear along a radial line orthogonal to a longitudinal axis of the driveshaft.

15. The bass drum pedal of claim 14, wherein said spring return assembly includes a shaft extending radially from the hub within a plane orthogonal to the longitudinal axis of the driveshaft.

16. The bass drum pedal of claim 15, wherein said adjustable retention means includes a collar selectively adjustably mounted on the shaft for selective slidable adjustment along the shaft.

17. The bass drum pedal of claim 16, wherein said adjustable retention means further includes a pin mounted on the collar with means for engaging the spring end.

* * * * *